US005852890A

United States Patent [19]

Pynenburg

[11] Patent Number: 5,852,890

[45] Date of Patent: Dec. 29, 1998

[54] MAGNETIC MODIFIABLE SIGN SYSTEM

[75] Inventor: Adrian W. Pynenburg, Brantford, Canada

[73] Assignee: Storeimage Programs Inc., Brantford, Canada

[21] Appl. No.: 713,145

[22] Filed: Sep. 12, 1996

[51] Int. Cl.[6] ..... G09F 7/04

[52] U.S. Cl. ..... 40/621; 40/600

[58] Field of Search ..... 40/621, 600

[56] References Cited

U.S. PATENT DOCUMENTS

| | | | |
|---|---|---|---|
| 2,254,810 | 8/1941 | Will | 40/621 X |
| 2,668,370 | 2/1954 | Trimble | 40/621 X |
| 3,093,919 | 6/1963 | Holtz | 40/621 |
| 3,987,567 | 10/1976 | Fritts | 40/600 |

FOREIGN PATENT DOCUMENTS

| | | | |
|---|---|---|---|
| 2080269 | 4/1993 | Canada | 40/600 |
| 2650689 | 2/1991 | France | 60/600 |

*Primary Examiner*—Cassandra H. Davis
*Attorney, Agent, or Firm*—Howard J. Greenwald

[57] ABSTRACT

A modifiable sign system comprised of a metal-containing substrate, a first plastic sheet attached to the top side of the substrate, and at least two flexible, magnetic sheets removably attached to the first plastic sheet. The first plastic sheet preferably has a thickness which is no greater than about 70 percent of the thickness of the two magnetic sheets.

1 Claim, 3 Drawing Sheets

MAGNETIC MODIFIABLE SIGN SYSTEM

FIELD OF THE INVENTION

A sign system containing a multiplicity of sign parts removably and magnetically attached to a metallic substrate.

BACKGROUND OF THE INVENTION

Food prices on a both a wholesale and retail level vary frequently and often substantially. Furthermore, the nature of food items which are promoted by food vendors varies. Thus, there is need to frequently change advertising signs in order for a store to appear to be competitive. When the store down the street is selling watermelon for $0.49 per pound, it is desirable to be able to change one's sign and sell the same watermelon for $0.45 a pound.

Unfortunately, most of the signs currently in use in supermarkets cannot readily be changed to create a new sign with a professional and esthetically pleasing appearance. Many of the personnel in supermarkets and being paid minimum wages, and few of them have the artistic ability and the intelligence necessary to readily produce new advertising signs when the need arises.

It is an object of this invention to provide a sign system which enables even workers of minimal skill to change signs in such a manner that the changed sign is correct, attractive, and appealing.

SUMMARY OF THE INVENTION

In accordance with this invention, there is provided a magnetic modifiable sign system comprised of a metal-containing base, a first layer of plastic material disposed on one side of the base, and a plurality of flexible magnetic materials removably attached to said first plastic material.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
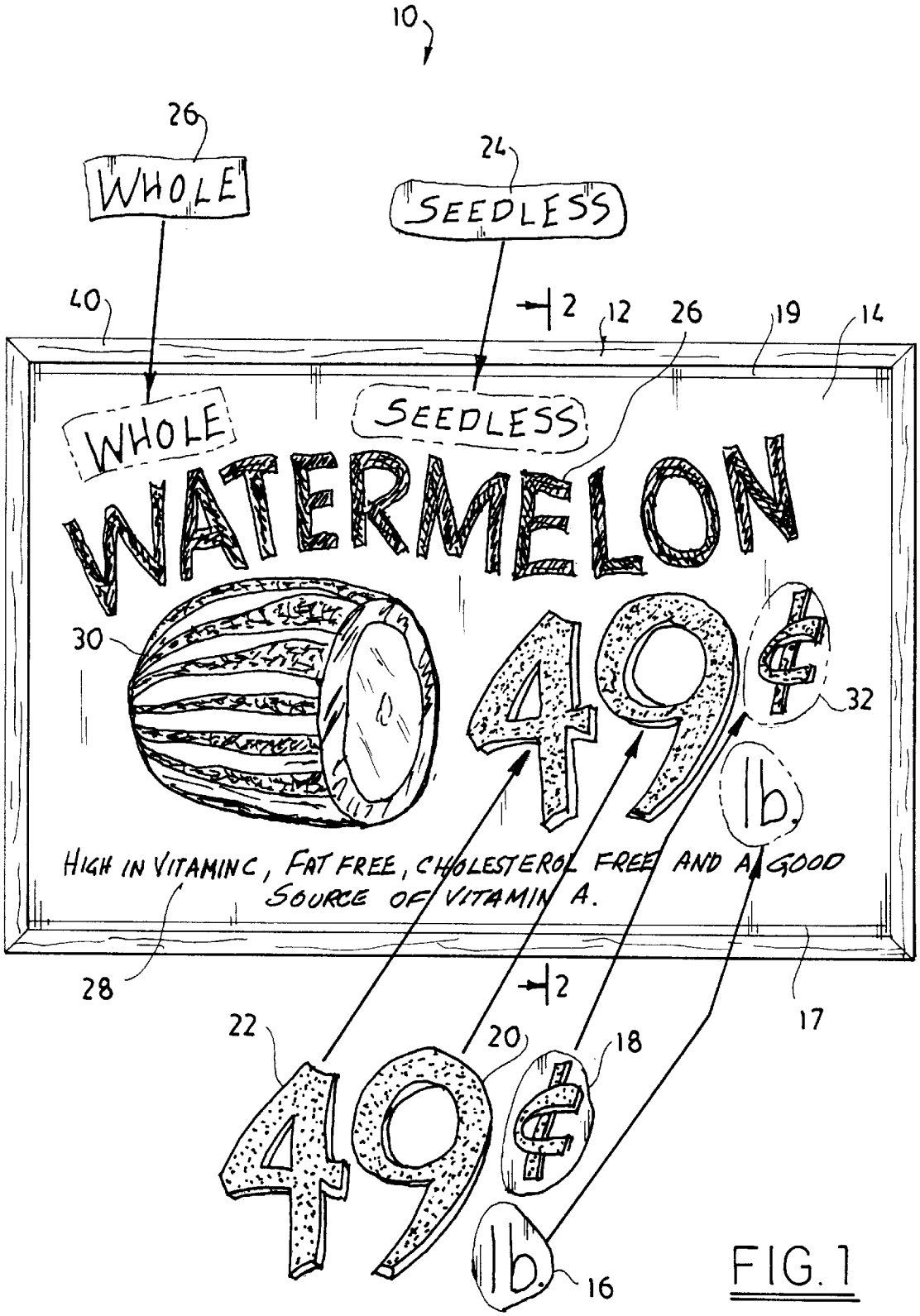
FIG. 1 is an exploded view of one preferred sign system of this invention.

FIG. 1 is perspective view of one preferred embodiment of applicant's magnetic sign system 10. Referring to FIG. 1, it will be seen that sign system 10 is comprised of frame 12, a first plastic material 14, and a multiplicity of die-cut flexible magnetic materials 16, 18, 20, 22, 24, and 26.

Referring again to FIG. 1, it will be seen that the first plastic material 14 has printed on it certain advertising graphics such as the phrase 26 "watermelon", the phrase 28 "HIGH IN VITAMIN C, FAT FREE, CHLORESTEROL FREE AND A GOOD SOURCE OF VITAMIN A", a graphic 30 depicting a ripe, juicy watermelon, and a graphic 32 depicting the "cents" symbol. As will be apparent to those skilled in the art, these advertising graphics are preferably fixed for any particular plastic material 14.

Figure 3:
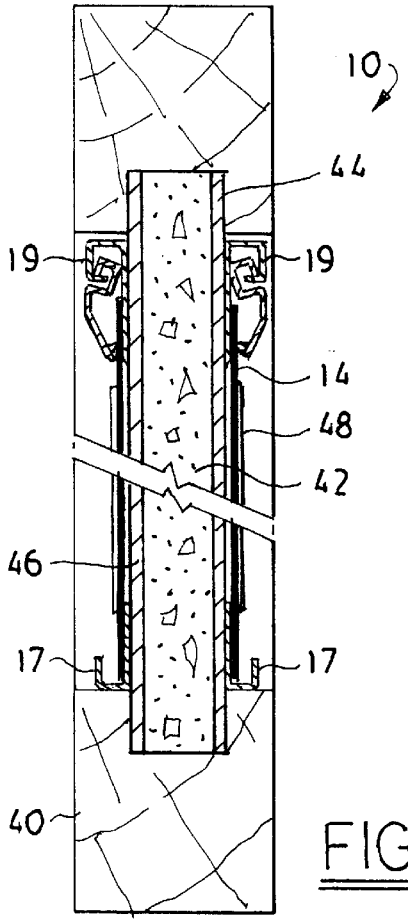
FIG. 3 is an expanded view of the sign system of FIG. 1 which is depicted in FIG. 2.
Figure 4:
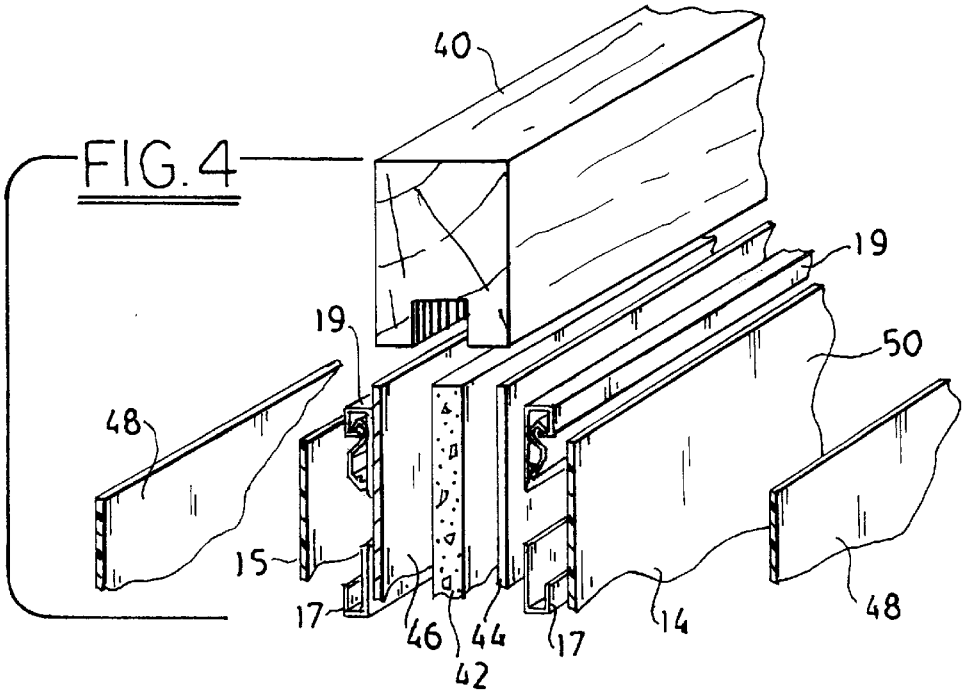
FIG. 4 is an exploded view of a portion of the sign system depicted in FIG. 3.

Referring to FIGS. 3 and 4, and in the preferred embodiment depicted therein, plastic material 14 is preferably attached to base 40 by means of a lower channel 17 and an upper snap panel holder 19.

Upper snap panel holder 19 preferably has the structure shown in U.S. Pat. No. 5,364,057, the entire disclosure of which is hereby incorporated by reference into this specification.

Thus, as is illustrated in U.S. Pat. No. 5,364,057, panel holder 19 preferably comprises a first longitudinal panel provided with a first planar portion and a first longitudinal, C-shaped flange attached to and running along a first peripheral edge thereof, wherein the C-shaped flange includes an outer wall and an inturned tongue attached to the outer wall and disposed toward and spaced from the first planar portion, and wherein the outer wall is spaced from the first planar portion a first predetermined distance.

Panel holder 19 also preferably includes a second longitudinal panel provided with a second planar portion and a second longitudinal C-shaped flange attached to and running along a first peripheral edge thereof, wherein the second C-shaped flange includes an inner wall portion having an outer surface, an upper wall attached to the inner wall portion and a peripheral lip attached to the upper wall, wherein the outer extremity of the peripheral lip is spaced from the outer surface a second predetermined distance, and wherein the peripheral lip extends transversely from the upper wall portion a third predetermined distance.

The second flange of the panel holder 19 is slidably received within the first flange, wherein the first predetermined distance is slightly smaller than the second predetermined distance and the third predetermined distance is less than the first predetermined distance, and wherein one of the flanges is resilient such that transverse rotation of one panel with respect to the other panel causes the panels to snap between an open and closed position.

The removable plastic material 14 preferably is a plastic material with a thickness of from about 10 to 30 mils. Thus, by way of illustration, plastic material 14 is a sheet plastic which consists essentially of a plastic such as acrylonitrile-butadiene-styrene (ABS), polyvinyl chloride, polystyrene, and the like.

In one embodiment, the plastic material 14 is high impact polystyrene which has a specific gravity of 1.054 to 1.070, a tensile strength of from about 4,000 to about 10,000 pounds per square inch, and a compressive strength of from about 12,000 to about 17,000 pounds per square inch.

As will be apparent to those skilled in the art, magnetic numeral indicia other than indicia 20 and 22 are available so that, as the price of watermelon changes, its price can readily be changed on plastic material 14. Similarly, the symbol 26 ("whole") can be replaced with another symbol (not shown) for "half". Similarly, the symbol 24 ("seedless") can be replaced with another symbol (not shown), such as "delicious".

Figure 2:
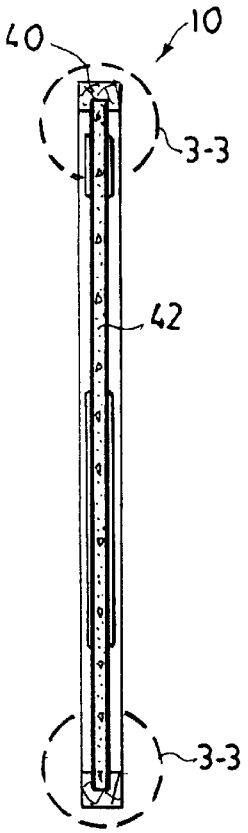
FIG. 2 is a sectional view of the sign system of FIG. 1, taken through lines 2—2.

FIG. 2 is a sectional view of the sign system 10 of FIG. 1. Referring to FIG. 2, and in the preferred embodiment depicted therein, it will be seen that sign system 10 is comprised of a frame 40, a sign base 42, a first metal-containing sheet 44, a second metal-containing sheet 46, a first plastic material 14, a second flexible plastic material 15, and a multiplicity of third flexible magnetic materials.

Referring again to FIG. 2, and in the embodiment depicted, sign system 10 is shown with the frame 40. In another embodiment, not shown, no frame 40 is present.

When a frame 40 is to be used, it is preferably made of wood, although frames made from other materials may also be used. Thus, e.g., frame 40 may be made out of plastic.

The plastic sheets 14 and 15 are preferably disposed on both sides of a metal-containing substrate preferably retained by a J-shaped plastic channel 17 at the bottom of the structure and a snap panel holder 19 at the top of the structure. In another embodiment, not shown, only one plastic sheet is disposed on a side of the metal-containing substrate.

In the embodiment depicted in FIG. 2, the metal-containing substrate is a composite substrate which preferably contains a hardboard base 42 to which is attached steel sheets 44 and 46. The hardboard base 42 preferably has a width of about 0.12 inches; and the sheet steel preferably has a width of about 0.03 inches.

The sheets 14 and 15 of plastic material preferably each have a thickness of from about 10 to about 20 mils. The top side of these sheets, such as side preferably have a white, printable surface so that graphics (such as the graphics 26, 20, 28, 30, and 32 of FIG. 1) can be printed on it.

The sheets 14 and 15 preferably have a substantially rectilinear shape. Thus, they may be in the shape of a rectangle (see FIG. 1), a square, etc.

In one preferred embodiment, each of sheets 14 and 15 has a cross-sectional area of at least about 120 square inches.

Each of sheets 14 and 15 have a width which is less than the thickness of the flexible magnetic members 48. It is preferred that the width of flexible sheets 14 and 15 be less than about 70 percent of the thickness of flexible magnetic members 48.

In one preferred embodiment, each of the flexible magnetic members 48 has a thickness of at least about 25 mils, and preferably from about 25 to about 60 mils. In one embodiment, the width of flexible sheets 14 and 15 is from about 40 to about 60 percent of the thickness of flexible magnetic members 48.

It is preferred that, attached to each of sheets 14 and 15, are at least two of the flexible magnetic members 48. In a more preferred embodiment, at least three such flexible magnetic members 48 are attached to the plastic sheets 14 and 15. In the embodiment depicted in FIG. 4, five such flexible magnetic members (members 16, 18, 24, 26, and 32) are used.

Figure 5:
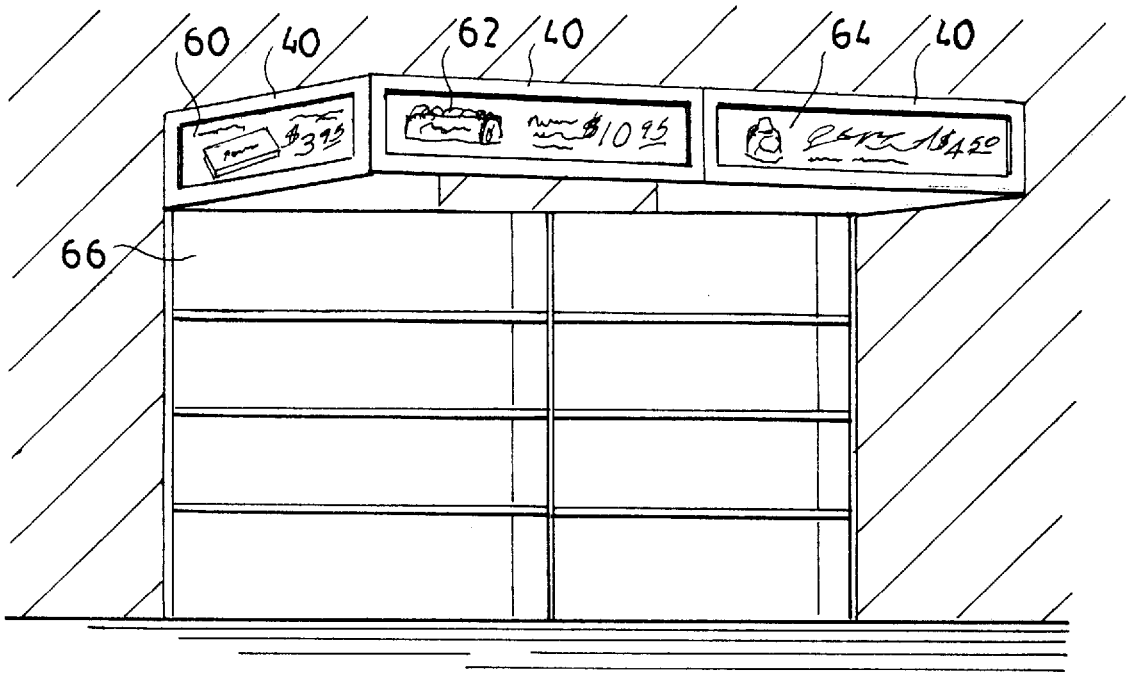
FIG. 5 is a perspective view of another preferred embodiment of the invention.

FIG. 5 is a perspective view of sign assemblies 60, 62, and 64 connected to a shelving unit 66. As will be apparent to those skilled in the art, in the embodiment of this Figure the flexible magnetic sheet 14 appears on only one side of the base (not shown).

Figure 6:
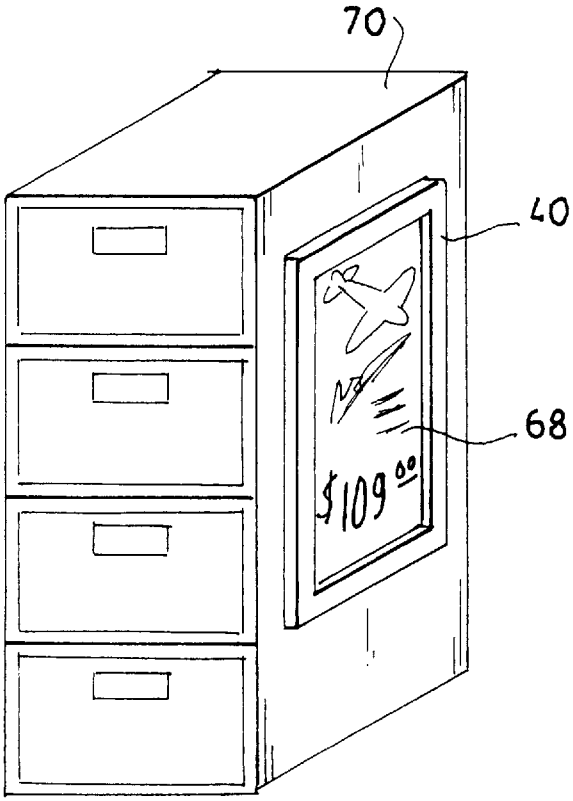
FIG. 6 is a perspective view of yet another preferred embodiment of the invention.

FIG. 6 is a perspective view of sign assembly 68 attached to the side of a file cabinet 70.

In another embodiment, not shown, plastic sheet 14 and/or plastic sheet 15 is replaced by a flexible magnetic sheet. In this embodiment, the removable magnetic material 14 and/or the removable magnetic material 15 may be any magnetic material which preferably is both flexible and magnetic. These materials are well known to those skilled in the art and include, for example, magnetic materials disclosed in U.S. Pat. Nos. 5,428,332 (magnetic rubber), 5,422,156 (flexible magnetic strip), 5,419,959 (flexible recording media), 5,409,590 (flexible magnetic material), 5,400,088 (velcro material attached to a flexible magnetic tape), 5,388,382 (magnetic strip), 5,383,534 (flexible magnetic member), 5,383,510 (flexible magnetic edge strips), 5,383,078 (flexible magnetic sheet), 5,357,061 (flexible magnetic substrate), 5,354,462 (flexible magnetic strap assembly), 5,336,498 (flexible pad with magnetic tape), 5,327,673 (flexible magnetic material), 5,312,145 (flexible magnetic material comprised of a polymer matrix), and the like. The disclosure of each of these United States patents is hereby incorporated by reference into this specification.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A modifiable sign system comprising a base comprising a substrate comprised of a first side and a second side and a steel sheet attached to said first side of said base, a first sheet comprised of plastic material which is removably disposed over said first side of said substrate, a second sheet comprised of flexible magnetic material which is magnetically attached to said steel sheet through said first plastic sheet, a third sheet comprised of flexible magnetic material which is magnetically attached to said substrate through said first sheet, a retaining clip attached to a top edge of said base and a J-shaped channel attached to a bottom edge of said base for removably retaining top and bottom edges of said first sheet respectively, and a frame for holding said base, said steel sheet, and said retaining clip, wherein:

(a) said first sheet has a thickness of from about 10 to about 20 mils, (b) each of said sheets has a thickness of at least 25 mils, provided that said thickness of said first sheet is less than about 70 percent of the thickness of said second sheet and said third sheet, (c) said base comprises a hardboard material.

* * * * *